United States Patent [19]

Benai et al.

[11] 4,361,532

[45] Nov. 30, 1982

[54] PROCESS FOR THE CONTINUOUS SPINNING OF VISCOSE RAYON

[75] Inventors: Tommaso Benai, Rieti; Ugo Paoletti, Monza; Novello Leoncini, Limbiate, all of Italy

[73] Assignee: Snia Viscosa Societa' Nazionale Industria Applicazioni Viscosa S.p.A., Milan, Italy

[21] Appl. No.: 223,925

[22] Filed: Jan. 9, 1981

[51] Int. Cl.[3] ..... D01F 3/12

[52] U.S. Cl. ..... 264/188; 264/196

[58] Field of Search ..... 264/188, 196

[56] References Cited

U.S. PATENT DOCUMENTS

| | | | |
|---|---|---|---|
| 2,440,057 | 4/1948 | Mallhiseu | 264/181 |
| 2,510,135 | 6/1950 | Pedlow et al. | 264/180 |
| 2,511,699 | 6/1950 | Dvisch et al. | 264/180 |
| 2,536,094 | 1/1951 | McDermott et al. | 264/180 |
| 2,974,363 | 3/1961 | Megern | 264/180 |
| 2,979,767 | 4/1961 | Fry | 264/180 |
| 3,452,129 | 6/1969 | Isobe et al. | 264/181 |

FOREIGN PATENT DOCUMENTS

| | | | |
|---|---|---|---|
| 42-15814 | 8/1967 | Japan | 264/181 |
| 45-36844 | 11/1970 | Japan | 264/188 |
| 50-18712 | 2/1975 | Japan | 264/188 |

*Primary Examiner*—Jay H. Woo

*Attorney, Agent, or Firm*—Wenderoth, Lind & Ponack

[57] ABSTRACT

A process is provided herein for continuously spinning viscose yarns by extruding viscose into a coagulating bath to form filaments and partially coagulating these filaments to a coagulation index of between 15 and 18, while concurrently stretching said filaments to the desired stretch ratio and then subjecting the filaments to a 2-stage coagulation treatment in which (1) the filaments are advanced without further chemical treatment onto e.g. a first advancing roller where partial spontaneous coagulation occurs such that the coagulation index is between 5 and 8 and (2) a second stage coagulation which comprises contacting the filaments with an acid bath at a temperature between 50° and 100° C. until complete coagulation occurs such that the coagulation index is between 0 and 1.

The aforementioned process permits the spinning operation to occur at a much greater speed than was hitherto possible without increasing dimensions of the treatment zones or apparatus.

6 Claims, 2 Drawing Figures

22
20
21

10
11
12
13
14

23
24
25
26
27

PROCESS FOR THE CONTINUOUS SPINNING OF VISCOSE RAYON

BACKGROUND OF THE INVENTION

The present invention relates to an improvement in the processes for the continuous spinning of viscose rayon.

Processes for the continuous spinning of viscose rayon are known, in which viscose, extruded from suitable spinnerets into a coagulating bath, undergoes coagulation and drawing in the same bath or in successive baths, and passes thereafter over a support and advancing apparatus which causes it to travel in a substantially helical path, viz. a path constituted by a series of successive coils which are not exactly helical but close to it; the yarn undergoing a series of treatments while it travels in said path, until it reaches the desired final characteristics. A type of apparatus adapted for causing the coagulated and drawn yarn to travel in a substantially helical path, and to which reference will be made hereinafter, is constituted of a main roller, having a relatively large diameter, and a series of secondary rollers having much smaller diameters, the axes thereof being set askew with respect to the preceding one. These latter rollers are normally called advancing rollers. The main roller is also called a treatment roller, because the chemical and thermal treatments occur on it. Since in devices of this kind, one yarn corresponds to each advancing roller, viz. a plurality of yarns concurrently travel in the apparatus and all travel on the periphery of the treatment roller and each one separately on the periphery of a distinct advancing roller, reference will be made, in describing the present invention, to an apparatus having a single advancing roller, and there fore the invention will be described with reference to only one yarn: it being understood, however, that when the invention is carried into practice, a plurality of yarns will generally be treated concurrently and consequently there will be more than one advancing roller.

The main or treatment roller, and consequently the substantially helical path of the yarn, is divided into several successive zones in the direction of travel of the yarn itself, viz. in the longitudinal direction of the treatment roller, a distinct treatment stage corresponding to each of said zones. Said various zones are normally separated by suitable, e.g. mechanical means, and one very simple separation means is constituted by flanges or pairs of flanges interposed between each zone and those adjacent thereto. Reference will be made, in describing the invention, to a device of this kind, it being understood however that the invention is independent of the particular mechanical means by which it is carried out.

In the previously known continuous processes of this type, the yarn undergoes coagulation and drawing in the same bath which it is extruded, or the yarn may be coagulated and drawn in successive baths. Alternatively, the yarn may be coagulated and drawn through a guide tube immersed in the bath and through which guide tube the bath flows over the yarn.

Thereafter, the yarn begins its helical travel, and the first operation it undergoes during this travel is an acid setting, ordinarily followed by a washing. Other treatment zones follow, which generally comprise desulphuration, bleach and finishing zones separated by washing zones, and drying zones, but the invention is not dependent on the treatments which follow the setting, as will be better understood hereinafter. The aforesaid treatment is normally carried out at yarn travel speeds not higher than 90 meters per minute, generally between 50 and 80 meters per minute. Under these operating conditions, the conventional cycle is adequate and satisfactory.

However, the need of increasing the yarn advancing speed in order to increase the production and therefore to reduce the cost of the yarn has been felt for some time. Obviously, this can be achieved by increasing the dimensions of the apparatus, in such a way that the various treatments will last the same periods of time that they last in the traditional cycle. Such a solution, however, is not desirable for cost and space take-up reasons, as well as for the difficulties of operating and maintaining an apparatus, which exceedes a certain dimension.

SUMMARY OF THE INVENTION

The present invention solves the problem of making it possible to increase the yarn treatment speed in processes of the aforesaid type, without increasing the dimensions of the treatment zones and therefore of the apparatus, and a substantial technical and economical progress is achieved thereby.

In order to better understand the invention, it is necessary to consider that, in the known art, the coagulation substantially precedes drawing, or the two operations occur in part practically concurrently. In other words—and this is the basis of all the artificial and synthetic yarns drawing processes—the yarn which is extruded in the liquid phase (either because it is molten, as in the case of thermoplastic filaments, or because it is in solution, as in the case of cellulosic filaments such as viscose rayon to which reference is made herein) must be brought first of all to the solid state, by systems or steps which are different according to the spinning techniques. Such steps may include cooling, solvent evaporation, and so forth, but which in the case of spinning viscose rayon by the wet spinning technique, the steps consist of coagulating the yarn in an acid and saline bath. The coagulated polymeric filaments, however, are not oriented; therefore a drawing operation is carried out, which involves the orientation of the macromolecules along the axis of the filaments. Ideally, therefore, the coagulation precedes the drawing operation. In practice, however, the two operations are concurrent at least in part, in as much as the drawing begins before the end of the coagulation and continues until coagulation is completed and thereafter, until the filament has acquired the desired degree of orientation. The development and the end of the coagulation may be checked by measuring the so called "coagulation index" or "$\gamma$ index", which measures the degree to which the said coagulation has been completed. Said index is defined and calculated as the number of moles of $CS_2$ per 100 glucosidic groups of the cellulose.

A yarn which has attained a $\gamma$ index of 0–1 is considered completely coagulated.

The process according to the invention is essentially characterized in that the yarn is subjected to a partial coagulation and to a drawing which are at least partially concurrent, until it reaches the predetermined complete drawing degree—which for viscose rayon yarns is normally between 20 and 50%—and a coagulation degree expressed by a $\gamma$ index of between 14 and 18. The yarn is then subsequently subjected, without any further drawing, to a treatment which will be called "post-coagulation," where it is completely coagulated to a final coagulation index of between 0 and 1, without undergoing any further drawing. The yarn is then subjected to all the other treatments necessary for the particular processing; said treatment steps, as a continuous spinning step and such steps as a setting, desulphuration, bleach and finishing step, as well as several washings, and a final drying procedure. The post-coagulation treatment is carried out preferably in two stages. In the first stage, the yarn does not undergo any treatment but the $\gamma$ index is spontaneously reduced generally to a value in the range of about 8 to about 5. In the second stage, the yarn is contacted with a setting bath, which is acid because it contains sulphuric acid, and which many contain salts, such as zinc sulphate and sodium sulphate, at temperatures of between 50° C. and 100° C. A typical composition of the bath includes the following components:

sulphuric acid $30 \div 70$ gr/lt
zinc sulphate $1.8 \div 4.2$ gr/lt
sodium sulphate $60 \div 140$ gr/lt At the end of the second stage the $\gamma$ index has been lowered to a final value of $0 \div 1$.

The duration of the post-coagulation treatment is obviously determined by the coagulation indices at the beginning and at the end thereof, but in practice it is between 15 and 40 seconds in the most common cases.

The two stages of the post-coagulation take place in two successive zones of the helical path which is defined in practice by the treatment roller and by one advancing roller.

DETAILED DESCRIPTION OF THE PREFERRED EMBODIMENTS

Figures 1, 2:
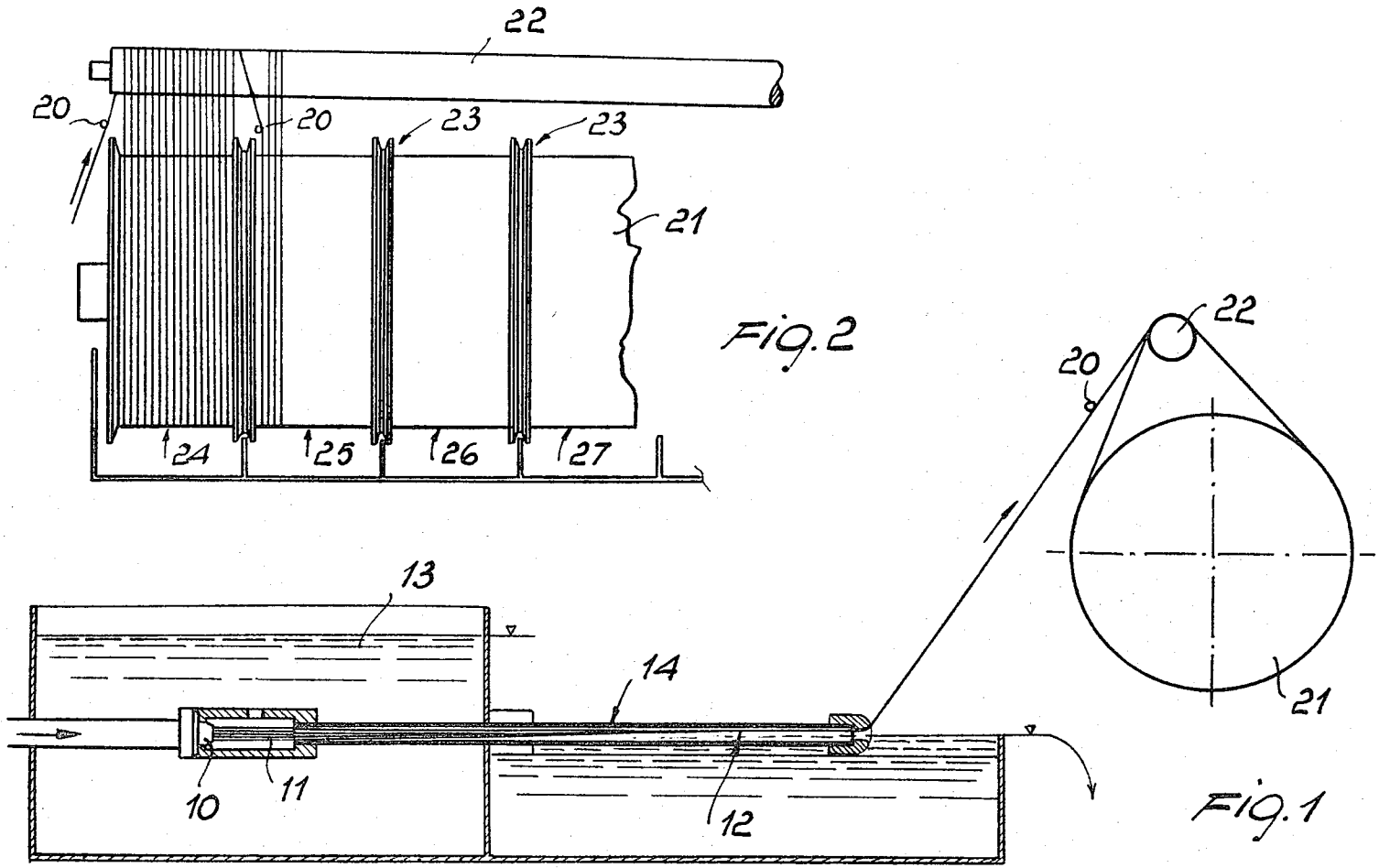

In a preferred form of the invention, the post-coagulation treatment is carried out while the yarn already travels in its helical path, along which it will then be subjected to the subsequent treatments required in each individual case. The process according to the invention has the wholly surprising effect of permitting one to spin viscose rayon in a continuous process of the type described, at speeds considerably higher than those attained hereinbefore, without increasing the dimensions of the treatment zones and therefore in shorter periods of time both in respect to the individual and overall treatment. This will be clearly evident from the following examples.

The progress thus achieved is wholly unforeseen and is surprising, not only because nothing has been suggested concerning applicants' inventive steps because of the fundamentally accepted principle that in spinning viscose rayon, the coagulation precedes the drawing and optionally is completed during the drawing itself, but is never carried out after the drawing. This principle is true not only in respect to rayon but also in respect to linear polymers in general. The division of the coagulation operations in several stages, one of which is subsequent to the drawing, constitutes a drastic and highly original novelty in the specific art.

The invention will be better understood from the description of a number of embodiments thereof, offered for illustrative and non-limitative purposes, with reference to the attached drawings, which schematically illustrate an apparatus that can be used for carrying out the process. The drawing omits those parts of the apparatus relative to the treatments which follow the washing after the post-coagulation, which treatments may be carried out by the traditional techniques or in different ways, without interfering with said invention, and in which:

FIG. 1 is a schematic end view of the apparatus, seen from the spinneret end; and FIG. 2 is a lateral view of a part of the rollers on which the yarns travel in a substantially helical path.

In the drawing, numeral 10 indicates the spinneret from which a bundle of filaments 11 issues, which filaments come together to form a yarn 12. The filaments are extruded into a coagulating bath 13 and the yarn passes through a guide tube 14 in which the bath flows in the same direction as the yarn. The yarn leaves the bath 13 and the tube 14, and passes, being guided by a yarn guide 20, to an advancing roller 22 and a treatment roller 21, which have axes askew to one another. As has been said, in practice there will be several advancing rollers and on each of them a different yarn travels, issuing from a different spinneret and separately coagulated and drawn. The treatment zones of roller 21 are separated by pairs of flanges 23. Such operation defines a first post-coagulation zone 24, a second post-coagulation zone 25, a zone 26 in which the yarn is washed after post-coagulation, whereafter the yarn will undergo all the other treatments which are desirable in the zone 27, shown as interrupted, and in successive zones, not illustrated.

The invention permits spinning of the viscose rayon with speed increases between 20 and 50% with respect to the conventional process, all other conditions being equal, and thus spinning speeds between 110 and 140 meters per minute are attained.

The draw ratio is determined by the ratio of the linear speed of the treatment roller—advancing rollers assembly, to the linear speeds of the filaments at the beginning of the coagulation in the vicinity of the spinneret 10. A part of the drawing occurs hydraulically in the guide tube 14. The coagulation index or $\gamma$ index which expresses the overall coagulation degree which the yarn has undergone before and during the drawing, is measured on the yarn itself before the post-coagulation zones, while the final coagulation index, corresponding to the condition of the filaments after the post-coagulation, is measured at the end of the zone 24.

Some specific examples will now be given of the preparation of yarns by the process according to the invention, all the yarns undergoing after the post-coagulation and the washings relative thereto, desulphuration, bleaching and finishing, followed by washings, and drying, such subsequent steps being known in the art.

EXAMPLE 1

A viscose having 8% of cellulose and 6% of soda, is spun, after suitable ripening, to a $\gamma = 37$ in a coagulating bath having the following composition:

$H_2SO_4 = 135$ gr/lt
$ZnSO_4 = 10$ gr/lt
$Na_2SO_4 = 260$ gr/lt at a temperature of 57° C.

The spinning of the viscose was carried out in a glass tube immersed in the coagulating bath, with a hydraulic head of about 100 mm.

The spinning speed was 100 mt/min, the coagulation or $\gamma$ index of the yarn along the path of the machine had the following values:

beginning of the post-coagulation sector=15
end of the first post-coagulation sector=5
end of the second post-coagulation sector=0–1
The periods of time in which the yarn remained in the treatment zones and the respective treatment liquors were as follows:

| Sectors | 1 | 2 | 3 | 4 | 5 | 6 | 7 | 8 | 9 |
|---|---|---|---|---|---|---|---|---|---|
| Treatment | First post coagulation zone | Second post-coagulation zone (setting) | Washing | Desulphuration | Washing | Bleach | Washing | Finishing | Drying |
| Treatment liquors | — | $H_2SO_4$:50 gr/lt $ZnSO_4$:3.5gr/lt $Na_2SO_4$:100 gr/lt Temperature 75° C. | $H_2O$ | $Na_2S$:4 gr/lt NaOH:1.5gr/lt Temperature 62° C. | $H_2O$ | NaOCl:1.2gr/lt Temperature 30° C. | $H_2O$ | Fats 1.3 gr/lt pH:8.3 Temperature 40° C. | |
| Yarn travel times through the sectors (seconds) | 17 | 12 | 12 | 19 | 12 | 12 | 12 | 11 | 12 |

The yarn obtained had the following characteristics:

| | |
|---|---|
| Count | 120 den |
| Tenacity in the conditioned state | 1.90 gr/den |
| Elongation in the conditioned state | 18% |
| Tenacity in the wet state | 0.85 gr/den |
| Elongation in the wet state | 33% |
| Ashes | 0.2% |
| Sulphur | 0.12% |

EXAMPLE 2

A viscose having the same composition as that of Example 1, was spun in a coagulating bath having the same composition of the previous one and under the same conditions, except that the spinning speed was now 110 mt/min. The coagulation or $\gamma$ index of the yarn along the path of the machine was as follows:

beginning of the post-coagulation sector=16
end of the first post-coagulation sector=6
end of the second post-coagulation sector=0–1

In the various yarn treatment zones, while the composition of the treatment liquors remains constant, the time of yarn travel in the various zones was as follows:

| Sector | 1 | 2 | 3 | 4 | 5 | 6 | 7 | 8 | 9 |
|---|---|---|---|---|---|---|---|---|---|
| Yarn travel times through the sectors (seconds) | 16 | 11 | 11 | 17 | 11 | 11 | 11 | 10 | 11 |

The yarn obtained had the following characteristics:

| | |
|---|---|
| Count | 120 den |
| Tenacity in the conditioned state | 1.88 gr/lt |
| Elongation in the conditioned state | 17% |

-continued

| | |
|---|---|
| Tenacity in the wet state | 0.83 gr/den |
| Elongation in the wet state | 32% |
| Ashes | 0.2% |
| Sulphur | 0.14% |

EXAMPLE 3

A viscose having 7.5% of cellulose and 5.5% of soda, was spun into a coagulating bath having the following composition:

$H_2SO_4$:130 gr/lt
$ZnSO_4$:8 gr/lt
$Na_2SO_4$:250 gr/lt
Temperature:55° C.

the remaining conditions being the same as in the preceding examples, except in that the spinning speeds was now 120 mt/min. The yarn coagulation index along the path of the machine was as follows:

beginning of the post-coagulation sector=18
end of the first post-coagulation sector=8
end of the second post-coagulation=0–2
The composition of the various yarn treatment liquors in the various zones remained constant, while the treatment times varied as follow:

| Sector | 1 | 2 | 3 | 4 | 5 | 6 | 7 | 8 | 9 |
|---|---|---|---|---|---|---|---|---|---|
| Yarn travel times through the sectors (seconds) | 14 | 10 | 10 | 15 | 10 | 10 | 10 | 9 | 10 |

The yarn obtained had the following characteristics:

| | |
|---|---|
| Count | 120 den |
| Tenacity in the conditioned state | 1.93 gr/den |
| Elongation in the conditioned state | 17% |
| Tenacity in the wet state | 0.90 gr/den |
| Elongation in the wet state | 30% |
| Ashes | 0.3% |
| Sulphur | 0.16% |

EXAMPLE 4

A viscose having the same composition as in the preceding example, was spun in the same coagulation bath and under the same spinning conditions in such a way as to obtain a yarn having a count of 75 den. The coagulation or $\gamma$ index of the yarn along the path of the machine was as follows:

beginning of the post-coagulation sector = 16
end of the first post-coagulation sector = 6
end of the second post-coagulation sector = 0–1

The composition of the treatment liquors and the periods of time through which the yarn remained in the various sectors was the same as in the preceding example.

The characteristics of the yarn obtained was as follows:

| | |
|---|---|
| Count | 75 den |
| Tenacity in the conditioned state | 1.85 gr/den |
| Elongation in the conditioned state | 16% |
| Tenacity in the wet state | 0.82 gr/den |
| Elongation in the wet state | 30% |
| Ashes | 0.2% |
| Sulphur | 0.14% |

We claim:

1. A process of continuously spinning viscose rayon yarns, comprising the steps of extruding said viscose into a coagulating bath to form filaments having a coagulation index of between 15 and 18 and concurrently stretching said filaments to the desired final stretch ratio and then subjecting the filaments to a two-stage coagulation treatment without any further stretching; (1) a first stage which comprises advancing the filaments outside of the bath without further chemical treatment until the filaments spontaneously attain a partial coagulation in which a coagulation index of between 5 and 8, is attained and (2) a second stage which comprises contacting the filaments with an acid bath at temperatures between 50° and 100° C. until a coagulation index between 0 and 1 is attained.

2. A process according to claim 1, wherein the acid bath contains sulphuric acid, zinc and sodium sulphate.

3. A process according to claim 1, wherein the two-stage coagulation treatments are carried out while the filaments is caused to travel in a helical path.

4. A process according to claim 3 wherein the yarn after leaving the bath is advanced to two rollers having their axes askew to one another; a first advancing roller whereby partial spontaneous coagulation occurs such that the coagulation index is between 5 and 8 and a second treatment roller wherein the filaments are treated to an acid constant whereby the coagulation is completed such that the coagulation index is between 0 and 1.

5. A process according to claim 1, wherein the coagulation treatments are carried out in a period of time between 15 and 40 seconds.

6. A process according to claim 1, carried out with filaments travel speeds between 100 and 120 meters per minute.

* * * * *